US006351954B1

(12) United States Patent
Nogawa et al.

(10) Patent No.: US 6,351,954 B1
(45) Date of Patent: Mar. 5, 2002

(54) PULSE TUBE REFRIGERATOR

(75) Inventors: Masafumi Nogawa, Toyota; Shaowei Zhu; Shin Kawano, both of Kariya; Tatsuo Inoue, Anjo, all of (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/694,035

(22) Filed: Oct. 23, 2000

(30) Foreign Application Priority Data

Oct. 21, 1999 (JP) ..... 11-299718

(51) Int. Cl.[7] ..... F25B 9/00
(52) U.S. Cl. ..... 62/6
(58) Field of Search ..... 62/6

(56) References Cited

U.S. PATENT DOCUMENTS 5,701,743 A * 12/1997 Hagiwara et al. ..... 62/6
5,845,498 A * 12/1998 Matsui et al. ..... 62/6
5,904,046 A * 5/1999 Kawano ..... 62/6
5,974,804 A * 11/1999 Sterling ..... 60/670
6,094,921 A 8/2000 Zhu et al.

OTHER PUBLICATIONS

"A Single Stage Five Valve Pulse Tube Refrigerator Reaching 32K", Advances in Cryogenic Engineering, vol. 43, (1998), p. 1983–1989.

* cited by examiner

*Primary Examiner*—William Doerrler
*Assistant Examiner*—Malik N. Drake
(74) *Attorney, Agent, or Firm*—Oblon, Spivak, McClelland, Maier & Neustadt, P.C.

(57) ABSTRACT

A pulse tube refrigerator includes a refrigerating portion including a regenerator, a low temperature heat exchanger, a pulse tube and a high temperature heat exchanger fluidically connected in this order. A first pressure oscillator includes a first compression source, a first high pressure supply valve, and a first low pressure supply valve. The regenerator is connected with outlet and inlet ports of the first compression source via the first high pressure supply valve and the first low pressure supply valve, respectively. A second pressure oscillator is provided independently of the first pressure oscillator and has a second compression source, a second high pressure supply valve, and a second low pressure supply valve. The high temperature heat exchanger is connected with outlet and inlet ports of the second compression source via the second high pressure supply valve and the second low pressure supply valve, respectively.

15 Claims, 5 Drawing Sheets

PULSE TUBE REFRIGERATOR

The entire disclosure of Japanese Patent Application No. Hei 11-299718 filed on Oct. 21, 1999, including the specification, drawings and abstract, is incorporated herein by reference in its entirety

BACKGROUND OF THE INVENTION

1. Field of the Invention

This invention relates to a pulse tube refrigerator and, more particularly, to a pulse tube refrigerator for cryogenic refrigeration.

1. Description of Related Art

A pulse tube refrigerator is useful as a cryogenic refrigerator. The pulse tube refrigerator refrigerates working fluid by oscillating the working fluid while shifting the phase of the pressure oscillation and displacement of the working fluid.

Various pulse tube refrigerators of this kind have been proposed, for instance by Yuan and J. M. Pfotenhauer "A single stage five valve pulse tube refrigerator reaching 32K", in Advances in Cryogenic Engineering, Vol. 43, (1998), P.1983. FIG. 5 is a block schematic diagram of the pulse tube refrigerator introduced in the above-mentioned publication. This pulse tube refrigerator 80 comprises a pressure oscillator 81 and a refrigerating portion 82.

The pressure oscillator 81 generates pressure oscillation to the working fluid filled in the pulse tube refrigerator 80 and comprises a compressor 83, a first high pressure supply on-off valve 84, a first low pressure supply on-off valve 85, a second high pressure supply on-off valve 86 and a second low pressure supply on-off valve 87. An outlet port of the compressor 83 is connected to both ends (left side and right side as viewed in FIG. 5) of the refrigerating portion 82 via the first high pressure supply on-off valve 84 and the second high pressure supply on-off valve 86 respectively. An inlet port of the compressor source 83 is connected to both ends of the refrigerating portion 82 via the first low pressure supply on-off valve 85 and the second low pressure supply on-off valve 87 respectively. The pressure oscillator 81 generates pressure oscillations in the working fluid (gas) in the pulse tube refrigerator 80 (refrigerating portion 82) by controlling the opening and closing of the first and second high pressure supply on-off valves 84, 86 and the first and second low pressure supply on-off valves 85, 87 at a predetermined timing.

The refrigerating portion 82 comprises a regenerator 91, a low temperature heat exchanger 92, a pulse tube 93 and a high temperature heat exchanger 94 connected in series in-line. A hot end of the regenerator 91 is connected to the pressure oscillator 81 via first high and low pressure supply valves 84 and 85. A cold end of the regenerator 91 is connected to the low temperature heat exchanger 92. The regenerator 91 gradually refrigerates the working fluid while the working fluid moves therethrough towards the low temperature heat exchanger 92 side and gradually heats the working fluid moving therethrough towards the pressure oscillator 81 side.

The low temperature/heat exchanger 92 connected to the cold end of the regenerator 91 generates a low temperature. In order to effectively remove the heat of a device to be refrigerated, such as an electronic device, in contact with the low temperature heat exchanger 92, the low temperature heat exchanger 92 is provided with a number of holes regularly formed along the flow direction of the working fluid.

The pulse tube 93 connected to the low temperature heat exchanger 92 is formed by a hollow tube having a cold end 93*a* on the low temperature heat exchanger 92 side and a hot end 93*b* on the high temperature heat exchanger 94 side. The pulse tube 93 is made of a material with low heat conductivity in order to prevent the transfer of the heat generated by the oscillation from the hot end side to the low temperature heat exchanger 92.

The high temperature heat exchanger 94 connected to the pulse tube 93 includes a number of holes regularly arranged along the flowing direction of the working fluid. The high temperature heat exchanger 94 cools the hot end side by releasing the heat of the working fluid flowing therethrough to the outside thereof. The high temperature heat exchanger 94 is connected to the second high and low pressure supply on-off valves 86 and 87.

The pressure oscillation of the working fluid in the pulse tube 93 is generated by controlling the opening and closing of the first high and low pressure supply valves 84 and 85 at a predetermined timing. The pressure oscillation of the working fluid in the pulse tube 93 is auxiliary generated by controlling the opening and closing of the second high and low pressure supply on-off valves 86 and 87 at a predetermined timing to adjust the phase lag between the phase of the pressure oscillation and the displacement of the working fluid in the pulse tube 93 of the pulse tube refrigerator 80. The working fluid (gas) is moved in one direction to release the heat at the high temperature heat exchanger 94 and moved in the other direction to absorb the heat at the low temperature heat exchanger 92. The continuous repetition of this cycle generates refrigeration at the low temperature heat exchanger 92. The operation of the pulse tube refrigerator 80 thus functions as a cryogenic refrigerator to generate refrigeration.

The above device, however, has a drawback that the operation is not stable, due to a circulation flow of working gas in a direction determined by the various operational conditions in addition to the above reciprocal movement of the flow of the working gas. This is because the conventional pulse tube refrigerator 80 forms a closed loop by the pressure oscillator 81 and the refrigerating portion 82, one end (regenerator 91 side) of which is connected to the other side (high temperature heat exchanger 94 side) through the pressure oscillator 81.

SUMMARY OF THE INVENTION

It is an object of the present invention to provide an improved pulse tube refrigerator which obviates the above conventional drawbacks.

It is another object of the present invention to provide an improved pulse tube refrigerator which is stable in operation.

According to the present invention, the above and other objects are advanced by a pulse tube refrigerator which includes a refrigerating portion including a regenerator, a low temperature heat exchanger, a pulse tube and a high temperature heat exchanger fluidically connected in this order; first pressure oscillation means for generating pressure oscillations of a working fluid in the pulse tube, said first pressure oscillation means comprising a first compressor, a first high pressure supply valve, and a first low pressure supply valve, wherein the regenerator is connected with outlet and inlet ports of the first compressor via the first high pressure supply valve and the first low pressure supply valve, respectively; and second pressure oscillation means provided independently of the first pressure oscillation means for adjusting a phase difference between the pressure oscillation and displacement of the working fluid in the pulse tube, said second pressure oscillation means having a second compression source, a second high pressure supply valve, and a second low pressure supply valve, wherein the high temperature heat exchanger is connected with outlet and inlet ports of the second compressor via the second high pressure supply valve and the second low pressure supply valve, respectively.

Since the second pressure oscillation means for adjusting the phase difference between the pressure oscillation and displacement of the working fluid is provided independently of the first pressure oscillation means, the first end second pressure oscillation means and the refrigerating portion do not form a closed loop, thereby preventing an undesired circulating flow of the working fluid and keeping the device in stable condition.

According to another aspect of the present invention, the pulse tube refrigerator further includes a buffer tank connected to the high temperature heat exchanger and having an intermediate pressure which is between the outlet and inlet pressures of the first compressor for further adjusting the phase difference between the pressure change and position change of the working fluid in the pulse tube. The buffer tank having the intermediate pressure between the outlet and inlet pressures of the first compression source is provided to further finely adjust the phase difference therebetween.

This feature will reduce the load of the first and second pressure oscillation means by first reducing the pressure change between the minimum pressure (inlet pressure of the first compression source) and an intermediate pressure (buffer tank pressure) at the pressure increasing operation of the working fluid in the pulse tube, and then increasing the pressure to the maximum pressure (outlet pressure of the first compression source) by opening the first high pressure supply valve.

According to a further aspect of the present invention, the buffer tank and the refrigerating portion are connected through a buffer side valve. This feature will also reduce the load of the first and second pressure oscillation means by first reducing the pressure change between the maximum pressure (outlet pressure of the first compression source) and the intermediate pressure (buffer tank pressure) at the pressure decreasing operation of the working fluid in the pulse tube, and then reducing the pressure to the minimum pressure (inlet pressure of the first compression source) by opening the first low pressure supply on-off valve.

According to still further aspect of the present invention, the opening state of the first high pressure supply valve is overlapped with at least a part of the opening state of the second high pressure supply valve at a pressure increasing stage of the working fluid in the pulse tube.

Since the opening state of the first high pressure supply valve is overlapped with at least apart of the opening state of the second high pressure supply valve at a pressure increasing stage of the working fluid in the pulse tube, working fluid, the pressure of which reaches the maximum level (outlet pressure of the first compression source), is flowing into the outlet port of the second compression source in its position change.

The generation of the pressure of the second compression source is assisted by the working fluid flowing into the outlet port to reduce the power or load needed et the second compression source.

According to still further aspect of the present invention, the opening state of the first low pressure supply valve is overlapped with at least a part of the opening state of the second low pressure supply valve at a pressure decreasing stage of the working fluid in the pulse tube.

Since the opening state of the first low pressure supply valve is overlapped with at least apart of the opening state of the second low pressure supply valve at a pressure decreasing stage of the working fluid in the pulse tube, working fluid, the pressure of which reaches the minimum level (inlet pressure of the first compression source), is flowing into the inlet port of the second compression source in its position change.

The generation of the pressure of the second compression source is assisted by the working fluid flowing into the inlet port to reduce the power or load needed at the second compression source.

According to still further aspect of the present invention, the pulse tube refrigerator includes a refrigerating portion formed by a regenerator, a low temperature heat exchanger, a pulse tube and a high temperature heat exchanger in line in this order, a first compression source having an outlet port and an inlet port, a first high pressure supply valve via which the outlet port of the first compression source connects to the regenerator, a first low pressure supply valve via which the inlet port of the first compression source connects to the regenerator, a second compression source haying en outlet port end en inlet port, a second high pressure supply valve vie which the outlet port of the second compression source connects to the high temperature heat exchanger, and a second low pressure supply valve vie which the inlet port of the second compression source connects to the high temperature heat exchanger.

Since the first compression source is provided independently of the second compression source, a closed loop formation is not formed, and an undesired circulating flow of the working fluid is not generated. Therefore, it is possible to keep the device in stable condition.

BRIEF DESCRIPTION OF THE DRAWINGS

These and other objects and features of the invention will be more apparent and more readily appreciated from the following detailed description of the preferred embodiment or the invention with the accompanying drawings, in which.

DESCRIPTION OF THE PREFERRED EMBODIMENT

Figure 1:
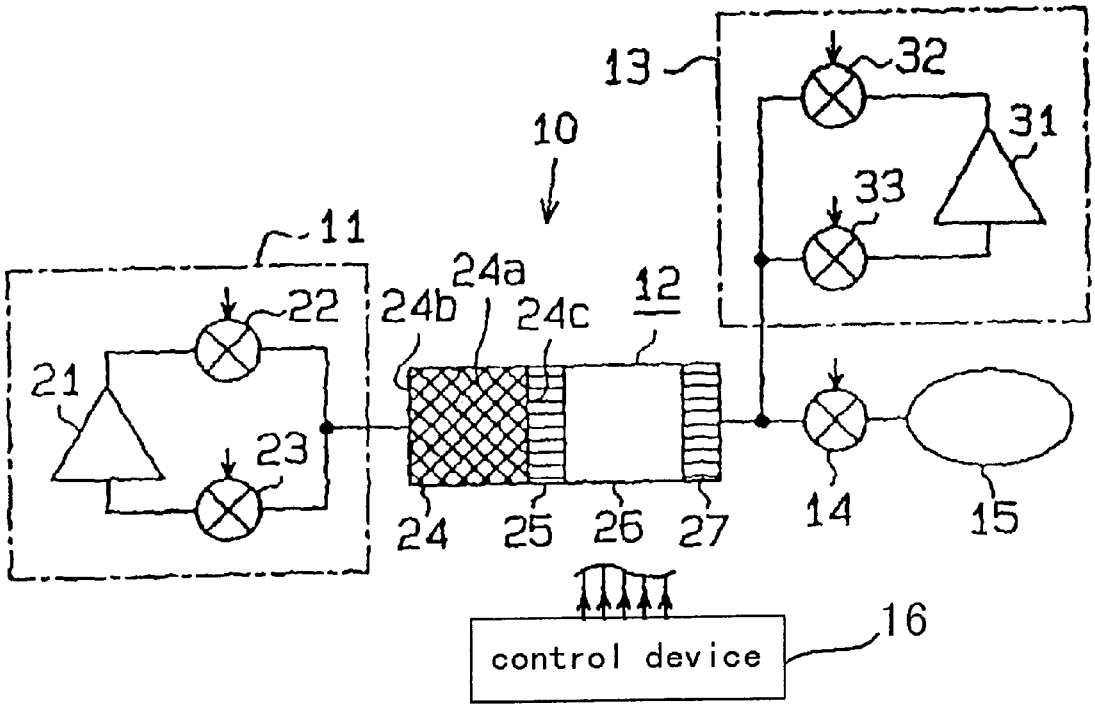
FIG. 1 is a block schematic diagram showing an embodiment a pulse tube refrigerator according to this invention.

An embodiment of a pulse tube refrigerator of this invention is described as follows, referring to FIGS. 1 through 4. As shown in FIG. 1, a pulse tube refrigerator 10 of this embodiment comprises a first pressure oscillator 11 , a refrigerating portion 12, a second pressure oscillator 13, a buffer side on-off valve 14, a buffer tank 15 and a control device 16.

The first pressure oscillator 11 includes a first compression source (compressor) 21, a first high pressure supply on-off valve 22, and a first low pressure supply on-off valve 23. The first pressure oscillator 11 generates pressure oscillations of the working fluid such as helium gas filled in the refrigeration portion 12 of the pulse tube refrigerator 10. An outlet port of the first compressor 21 is connected in fluid communication with the refrigerating portion 12 via the first high pressure supply on-off valve 22. An inlet port of the first compressor 21 is connected in communication with the refrigerating portion 12 via the first low pressure supply on-off valve 23. Opening and closing of the first high pressure supply on-off valve 22 and the first low pressure supply on-off valve 23 are controlled by the control device 16 at a predetermined timing. The first pressure oscillator 11 generates pressure oscillation of the working fluid in the refrigerating portion 12 of the pulse tube refrigerator 10 by this control (Generation of the pressure oscillation of the working fluid in the refrigerating portion 12 of the pulse tube refrigerator 10 is controlled by the operation of the first high pressure supply on-off valve 22 and the first low pressure supply on-off valve 23).

The refrigerator 12 includes a regenerator 24, a low temperature heat exchanger 25, a pulse tube 26 and a high temperature heat exchanger 27 connected in series in-line. The regenerator 24 filled with a regenerative material 24*a* supported by a mesh made of a material such as stainless steel or phosphor bronze. The regenerator 24 has a hot end 24*b* and a cold end 24*c*. The hot end 24*b* is connected to the outlet port of the first compressor 21 via the first high-pressure supply on-off valve 22 and to the inlet port of the first compressor 21 via the first low pressure supply on-off valve 23, respectively. The cold end 24*c* is connected to the low temperature heat exchanger 25. The regenerator 24 exchanges heat with the working fluid. The working fluid is refrigerated when the working fluid moves therein towards the low temperature heat exchanger 25 side and is heated when the working fluid moves towards the first pressure oscillator 11 side.

The low temperature heat exchanger 25 connected to the cold end 24*c* of the regenerator 24 generates a low temperature. In order to effectively remove heat from a device to be refrigerated contacted thereto, the low temperature heat exchanger 25 is formed, for instance, with a number of regularly arranged holes along the flow direction of the working fluid or made of a material with high heat conductivity such as bronze.

The pulse tube 26 connected to the low temperature heat exchanger 25 is a hollow tube having a cold end and a hot end on the low temperature heat exchanger 25 side and on the high temperature heat exchanger 27 side, respectively. In order to prevent heat transfer from the hot end side to the low temperature heat exchanger 25 by the oscillation of the working fluid, the pulse tube 26 is made of the material with low heat conductivity such as stainless steel.

The high temperature heat exchanger 27 connected to the pulse tube 26 is formed, for example, with a number of regularly arranged holes along the flow direction of the working fluid and is made of bronze. The high temperature heat exchanger 27 refrigerates the hot end side of the pulse tube by releasing the heat of the working fluid flowing therethrough. The high temperature heat exchanger 27 is connected to a buffer side on-off valve 14 and a second pressure oscillator 13.

The buffer side on-off valve 14 provided between the high temperature heat exchanger 27 of the refrigerating portion 12 and the buffer tank 15 adjusts the phase lag between the pressure oscillation and displacement of the working fluid in the pulse tube 26 by opening and closing at a predetermined timing under the control of the control device 16. The capacity of the buffer tank 15 is larger than that of the refrigerating portion 12. The pressure of the working fluid in the buffer tank 15 is defined as an intermediate pressure between the outlet pressures and inlet pressures of the first compressor 21 and a second compressor 31, which will be later described in detail.

The second pressure oscillator 13 is provided between the high temperature heat exchanger 27 of the refrigerating portion 12 and the buffer side on-off valve 14. The second pressure oscillator 13 serves as an auxiliary oscillator for generating pressure oscillations of the working fluid in the pulse tube 26 (pulse tube refrigerator 10) and includes a second compression source 31 (compressor), a second high pressure supply on-off valve 32 and a second low pressure supply on-off valve 33.

The outlet of the second compressor 31 is connected to the refrigerating portion 12 (high temperature heat exchanger 27) via the second high pressure supply on-off valve 32, while the inlet of the second compressor 31 is connected to the refrigerating portion 12 (high temperature heat exchanger 27) via the second low pressure supply on-off valve 32. Pressure oscillations are generated by the control device 16, by operating the opening and closing of the second high and low pressure supply on-off valves 32 and 33 at a predetermined timing to adjust the phase difference between the pressure oscillation and displacement of the working fluid in the pulse tube 26.

The outlet pressure of the second compressor 31 is approximately the same as that of the first compressor 21. The capacity and the flow rate of the working fluid or-the second compressor 31 are set to be smaller than that of the first compressor 21, respectively.

The control device 16 controls the first high pressure supply on-off valve 22, the first low pressure supply on-off valve 23, the buffer side on-off valve 14, the second high pressure supply on-off valve 32 and the second low pressure supply on-off valve 33 at a predetermined timing respectively. These valves and the control device may be formed integrally, such as by a rotary valve unit which includes a rotor, a stator and a motor.

Figure 2:
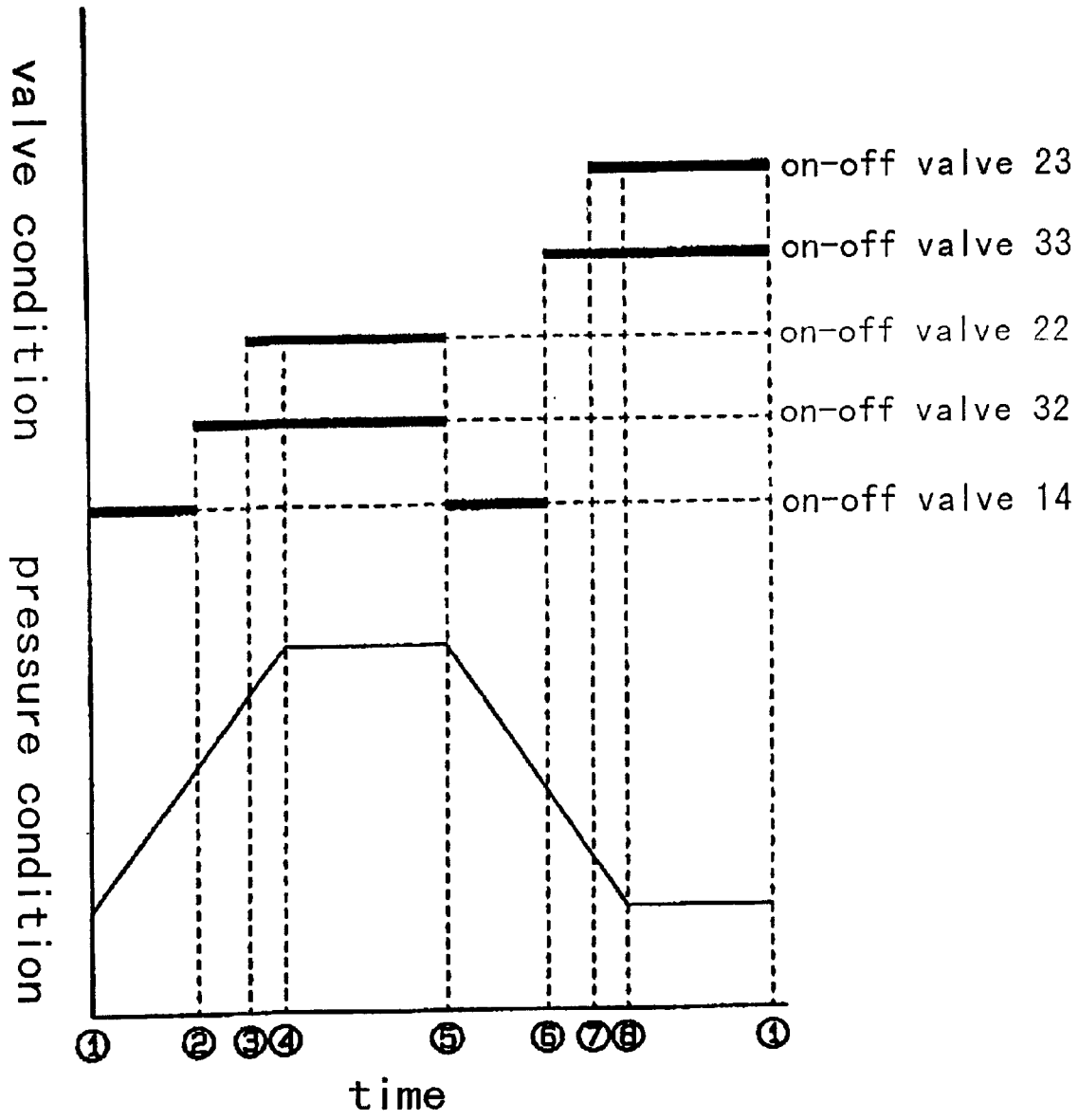
FIG. 2 is a line chart illustrating the operation conditions of each on-off valve and the pressure conditions of the working fluid of the pulse tube refrigerator of the embodiment of this invention.
Figure 3:
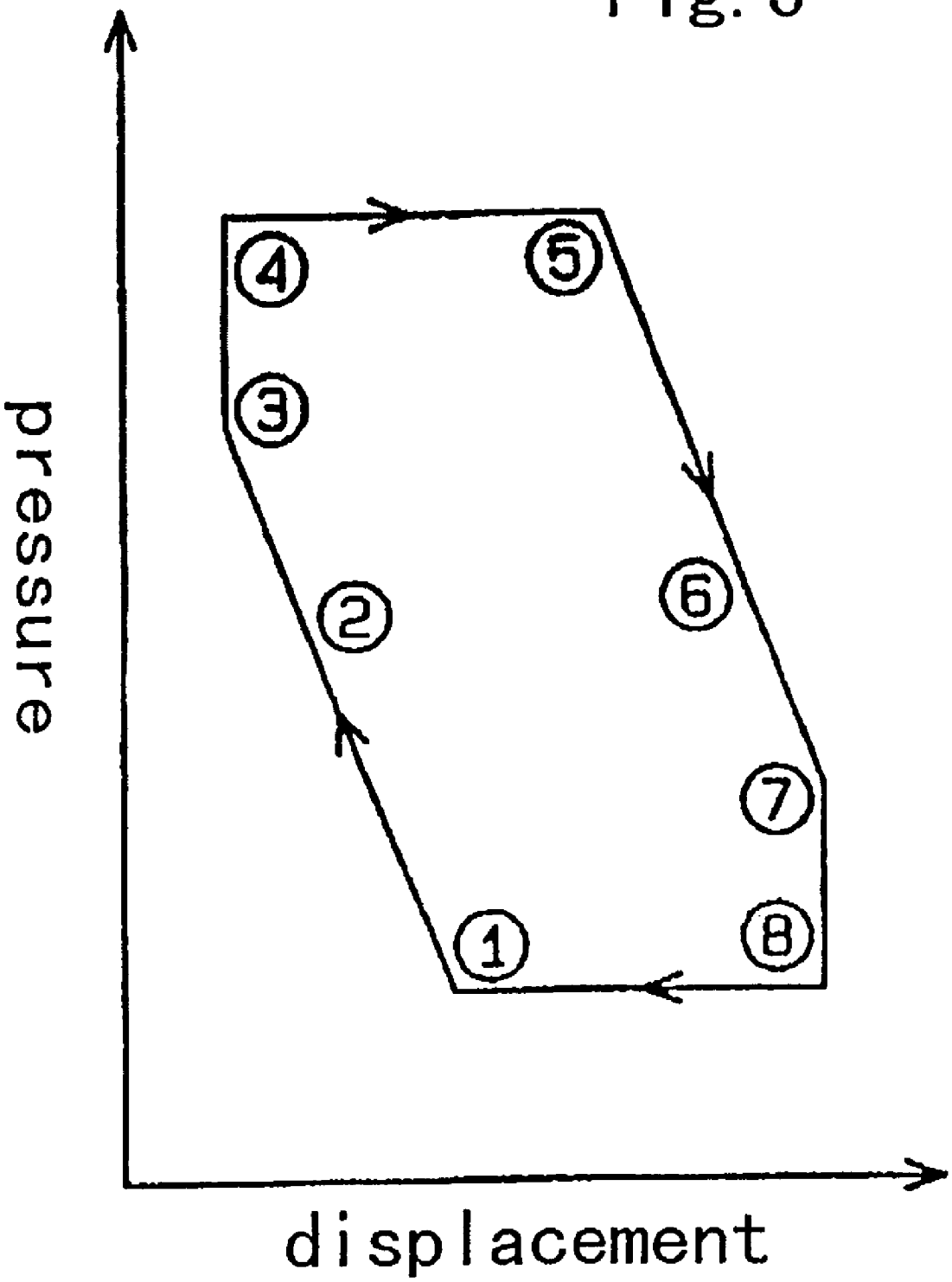
FIG. 3 is a line chart showing the equivalent PV relation of working fluid around the cold end of the pulse tube of the embodiment of this invention.

The operation of the pulse tube refrigerator 10 of this embodiment of the present invention will be explained with reference to FIG. 2 and FIG. 3 as follows. FIG. 2 is a line chart showing the opening and closing conditions of the first high pressure supply on-off valve 22, the first low pressure supply on-off valve 23, the buffer side on-off valve 14, the second high pressure supply on-off valve 32 and the second low pressure supply on-off valve 33, and the pressure condition in the pulse tube 26 at the cold end (low temperature heat exchanger 25) at each timing in one cycle of operation. FIG. 3 is a graph showing an equivalent P-V relation of the working fluid around the cold end of the pulse tube 26 at the same timing.

In FIG. 2, the bold lines indicate an opening condition of the first high pressure supply on-off valve 22, the first low pressure supply on-off valve 23, the buffer side on-off valve 14, the second high pressure supply on-off valve 32 or the second low pressure supply on-off valve 33. The dash lines show the closed condition of each valve above.

The operation of the pulse tube refrigerator 10 consists of eight (8) stages, and each stage is defined by opening and closing operations of the on-off valves 22, 23, 32, 33 and 14.

(1) The first stage (condition ① to ②: first compression stage)

In this stage, the first low pressure supply on-off valve 23 and the second low pressure supply on-off valve 33 are closed, the buffer side on-off valve 14 is opened, and the first high pressure supply on-off valve 22 and the second high pressure supply on-off valve 32 are closed. Under these valve conditions, the working fluid at the intermediate pressure level in the buffer tank 15 flows into the refrigeration portion 12 from the hot end of the pulse tube 26 (high temperature heat exchanger 27 side) via the buffer side on-off valve 14 (opened).

The pressure in the pulse tube 26 increases promptly from a minimum level to the intermediate level (pressure level in the buffer tank 15) via valve 14 with relatively low pressure loss by the communication between the refrigerating portion 12 and the buffer tank 15.

(2) The second stage (condition ② to ③: middle compression stage)

In this stage, the second high pressure supply on-off valve 32 is opened, the buffer side on-off valve 14 is closed. Under these valve conditions, the working fluid from the second compressor 31 is flowing into the refrigerating portion 12 from the hot end of the pulse tube 26 (high temperature heat exchanger 27 side) via the second high pressure supply on-off valve 32.

The pressure in the pulse tube 26 further increases promptly from the intermediate level (pressure level in the buffer tank 15) due to the interruption between the buffer tank 15 and the refrigerating portion 12 by the valve 14. (③ in the drawing).

(3) The third stage (condition ③ to ④: last compression stage)

In this stage, the first high pressure supply on-off valve 22 is opened during the increase of pressure in the pulse tube 26.Under these valve conditions, the working fluid from the first compressor 21 also flows into the refrigerating portion 12 from the hot end 24 of the regenerator 24 via the first high pressure supply on-off valve 22. The pressure in the pulse tube 26 further increases promptly to a maximum level. In the pulse tube 26 under this condition, the working fluid flows into the pulse tube 26 from the cold end via first compressor 21, first high pressure supply on-off valve 22, regenerator 24 and the low temperature heat exchanger 25, and further from the hot end via the second compressor 31, second high pressure supply on-off valve 32, and the high temperature heat exchanger 25. Accordingly, displacement of the working fluid around the cold end of the pulse tube 26 (low temperature heat exchanger 25 side) is controlled to be stable ④ in FIG. 3).

(4) The fourth stage (condition ④ to ⑤: high pressure transfer stage).

The condition ④ is kept and the first and second high pressure supply on-off valves 22, 32 are kept opened at the same time, but since the flow mass rate of the first compressor 21 is larger than that of the second compressor 31, the working fluid flows into the second compressor 31 side and the working fluid in the pulse tube 26 flows from the cold end to the hot end, keeping the pressure level to the maximum. Accordingly, displacement of the working fluid (high pressure transfer) occurs.

(5) The fifth stage (condition ⑤ to ⑥: first expansion stage).

In this stage, the first and second high pressure supply on-off valves 22 and 32 are closed while the buffer side on-off valve 14 is opened. Under these valve conditions, the working fluid in the refrigerating portion 12 flows into the buffer tank 15 from the hot end (high temperature heat exchanger 27 side) via the buffer side on-off valve 14 with relatively low pressure loss.

Since the communication between the buffer tank 15 and the refrigerating portion 12 are established by the opening of the buffer side on-off valve 14, the pressure in the pulse tube 26 is promptly reduced from the maximum level to generate adiabatic expansion of the working fluid therein, to reduce the temperature.

(6) The sixth stage (condition ⑥ to ⑦: middle expansion stage).

When the pressure in the pulse tube 26 decreases from the maximum level to the intermediate level (pressure level in the buffer tank 15), the second low pressure supply on-off valve 33 is opened and the buffer side on-off valve 14 is closed. Under these valve conditions, the working fluid in the refrigerating portion 12 flows into the second compressor 31 from the hot end of the pulse tube 26 (high temperature heat exchanger 27 side). In this condition, the communication between the buffer tank 15 and the refrigerating portion 12 is shut by the closing of the buffer side on-off valve 14, and the pressure in the pulse tube 26 is further reduced to generate adiabatic expansion of the working fluid therein, to reduce the temperature.

(7) The seventh stage (condition ⑦ to ⑧: last expansion stage).

During the pressure reducing operation of the pulse tube 26, the first low pressure supply on-off valve 23 is opened. Under these conditions, the working fluid in the refrigerating portion 12 flows into the first compressor 21 via the cold end of the pulse tube 26, low temperature heat exchanger 25, regenerator 24 and the first low pressure supply on-off valve 23. The pressure of the working fluid in the pulse tube 26 is promptly reduced to the minimum level. This will generate adiabatic expansion of the working fluid to further reduce the temperature. In the pulse tube 26 under this condition, the working fluid in the pulse tube 26 flows out from the cold end to the first compressor 21 via the low temperature heat exchanger 25 regenerator 24 and the first low pressure supply on-off valve 22, and from the hot end to the second compressor 31 via the high temperature heat exchanger 27 and the second low pressure supply on-off valve 33. Accordingly, displacement of the working fluid around the cold end of the pulse tube 26 (low temperature heat exchanger 25 side) is controlled to be stable ⑧ in FIG. 3).

(8) The eighth stage (condition ⑧ to ⑨: low pressure transfer stage).

The first and second low pressure supply on-off valves 23 and 33 are opened at the same-time, but since the flow mass rate of the first compressor 21 is larger than that of the second compressor 31, the pressure of the working fluid in the pulse tube 26 is kept to a minimum and flows from the hot end to the cold end to return to its original condition (first stage). Accordingly, displacement of the working fluid (low pressure transfer) occurs.

The eight stages explained above constitute one cycle, and a repetition of this cycle generates the condition changes shown in the equivalent P-V characteristics in FIG. 3 to generate cryogenic refrigeration at the low temperature heat exchanger 25 of the pulse tube refrigerator 10.

The described and explained pulse tube refrigerator according to the embodiment of the invention has the following advantages:

(1) The pulse tube refrigerator 10 includes first and second pressure oscillators 11 and 13 provided independently of each other at respective ends of the refrigerating portion 12 (one end at the regenerator side and the other end at high temperature heat exchanger 27 side) Each oscillator 11 and 13 independently controls the pressure change in the refrigerating portion 12. This structure does not form a closed loop of fluid circulation by the refrigerating portion 12, and the pressure oscillators 11 and 13 do not to generate undesired fluid circulation as in the conventional closed loop structure. The operation of the pulse tube refrigerator 10 of this embodiment can be performed while keeping a stable condition by avoiding such undesired fluid circulation. Further, the capacity or outlet pressure and the performance of the first and second pressure oscillators 11 and 13 can be adjusted independently to provide a properly selected performance of the refrigerator.

(2) In the fourth stage, the first and second high pressure supply on-off valves 22 and 32 are opened at the same time to let the working fluid flow into the second compressor 31 (the opening condition of the first high pressure supply on-off valve 22 is overlapped with a part of the opening condition of the second high pressure supply on-off valve 32 at a pressure increasing stage). The generation of pressure at this second compressor is assisted by the working fluid to reduce the load needed at the second compressor 31.

Further, in the eighth stage, the first and second low pressure supply on-off valves 23 and 33 are opened at the same time to let the working fluid suction from the second compressor 31 (the opening condition of the first low pressure supply on-off valve 23 is overlapped with a part of the opening condition of the second low pressure supply on-off valve 33 at a pressure decreasing stage). The generation of the pressure at this second compressor is assisted by the working fluid to be suctioned to reduce the load needed at the second compressor 31.

(3) According to the compression stages of the embodiment (from the first stage to the third stage), the buffer tank 15 is connected via the buffer side on-off valve 14 to increase the pressure of the pulse tube 26 from the minimum to an intermediate level (pressure defined by the buffer tank 15). After that, the first high pressure supply on-off valve 22 is opened under the intermediate pressure condition and the pressure increase to the maximum pressure. Accordingly, the compression source works to increase pressure from intermediate pressure to maximum pressure, and the load of the first and second pressure oscillators 11 and 13 can be reduced compared to the case when the first high pressure supply on-off valve 22 is opened under the minimum pressure condition (in this case, the compression source has to work to increase pressure from minimum pressure to maximum pressure).

Further, in the expansion stages from fifth to seventh, first the pressure in the pulse tube 26 is reduced to the intermediate from the maximum and then further reduced from the intermediate to the minimum by opening the first low pressure supply on-off valve 23 to achieve the same effect.

(4) Since the embodiment uses the buffer tank 15 at the refrigerating portion 12 via the on-off valve 14, at the first stage the buffer tank and the refrigerating portion are connected via the on-off valve 14 with relatively low pressure loss. The pressure in the pulse tube 26 is promptly increased from the minimum level to the intermediate level and at the fifth stage the pressure in the pulse tube 26 is promptly reduced from the maximum to the intermediate level. This will shorten the operation time for the condition change at the first and fifth stages.

(5) Further, at the seventh stage, in the pulse tube 26 under this condition, the working fluid in the pulse tube 26 flows out from the cold end to the first compressor 21, via the low temperature heat exchanger 25, regenerator 24 and the first low pressure supply on-off valve 22, and further from the hot end to the second compressor 31 via the high temperature heat exchanger 27 and the second low pressure supply on-off valve 33. Accordingly, displacement of the working fluid around the cold end of the pulse tube 26 (low temperature heat exchanger 25 side) is controlled to be stable in this stage (⑧ in FIG. 3). It can improve the refrigeration efficiency by enlarging the area enclosed by the P-V line in FIG. 3 at this stage.

Figure 4:
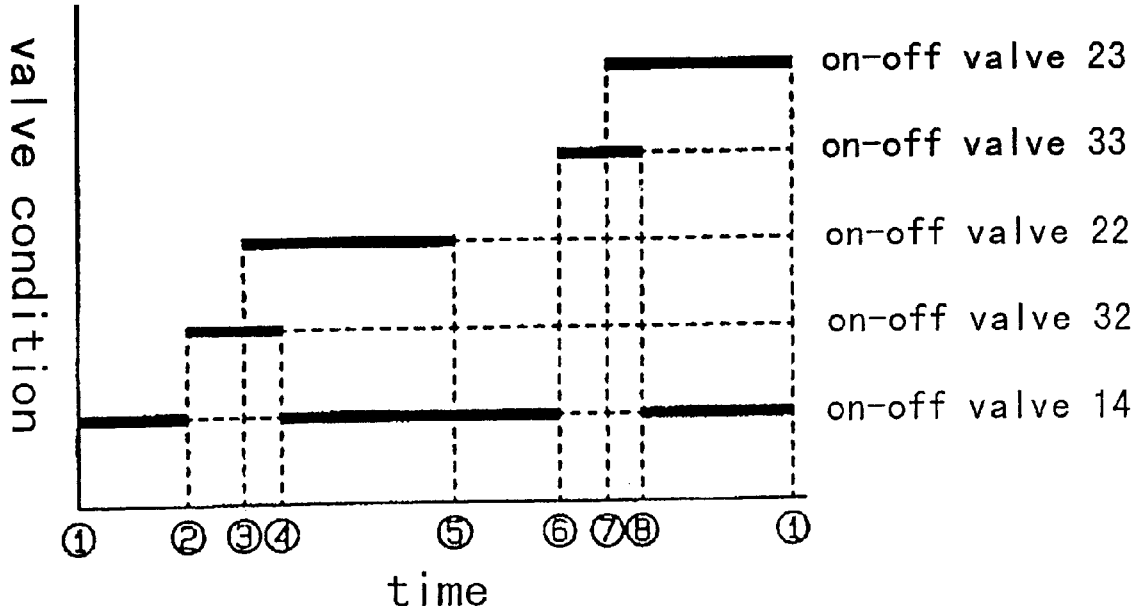
FIG. 4 is a line chart illustrating the operation conditions of each on-off valve and the pressure conditions of the working fluid of the pulse tube refrigerator of another embodiment of this invention.
Figure 5:
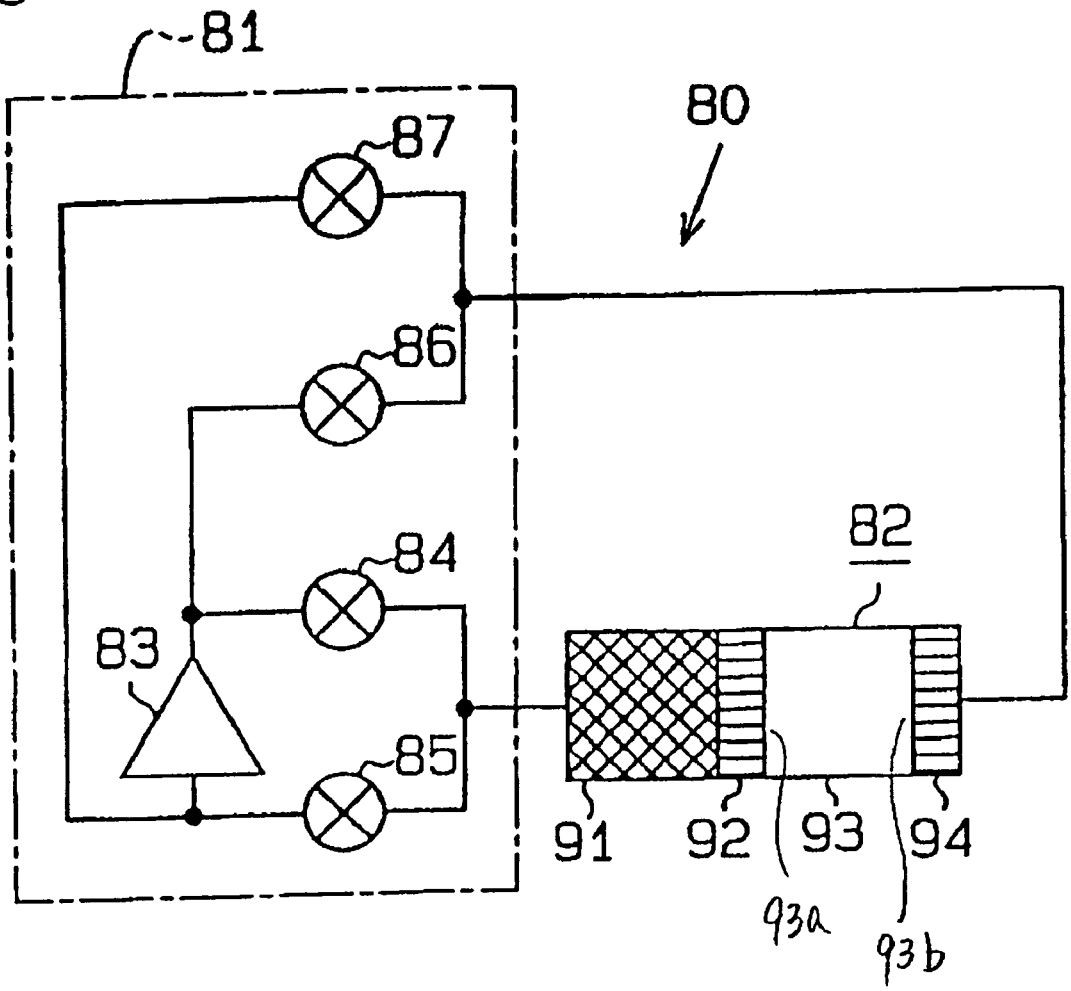
FIG. 5 shows a block schematic diagram showing a conventional pulse tube refrigerator.

The present invention is not limited to the embodiment explained above. For example, the valve opening and closing timing can be changed as illustrated in FIG. 4, wherein the same effects can be achieved by this embodiment as stated in (1), (3) to (5).

Other combination of the valve opening and closing conditions can be adopted in the same timing in one cycle.

According to the embodiment explained, the valve opening and closing timing of one cycle is fixed and repeated in the same order, but it can be changed, for example to set different conditions between the initiation of operation and during operation.

The embodiment adopts an on-off valve 14 as the buffer side valve, but an orifice valve of the needle type may instead be used to regulate the flow of the working fluid.

The buffer tank 15 and the on-off valve 14 are used in the embodiment, but they are not necessarily used. By not using the buffer tank, the size of the pulse tube refrigerator 12 can be minimized.

The output pressure of the first and second compressors 21 and 31 may be defined to be the same in this embodiment, but this may be defined to be different.

As the working fluid, Helium, Neon, Argon, Nitrogen or air may be used, or a combination thereof.

It is intended that the foregoing detailed description be regarded as illustrative rather than limiting and that it is understood that the following claims including all equivalents are intended to define the scope of the invention.

What is claimed is:

1. A pulse tube refrigerator comprising:

a refrigerating portion including a regenerator, a low temperature heat exchanger, a pulse tube and a high temperature heat exchanger fluidically connected in this order;

first pressure oscillation means for generating pressure oscillations of a working fluid in the pulse tube, said first pressure oscillation means comprising a first compression source, a first high pressure supply valve, and a first low pressure supply valve, wherein the regenerator is connected with outlet and inlet ports of the first compression source via the first high pressure supply valve and the first low pressure supply valve, respectively; and second pressure oscillation means provided independently of the first pressure oscillation means for adjusting a phase difference between the pressure oscillation and displacement of the working fluid in the pulse tube, said second pressure oscillation means having a second compression source, a second high pressure supply valve, and a second low pressure supply valve, wherein the high temperature heat exchanger is connected with outlet and inlet ports of the second compression source via the second high pressure supply valve and the second low pressure supply valve, respectively.

2. A pulse tube refrigerator according to claim 1, further comprising:

buffer means connected to the high temperature heat exchanger for keeping an intermediate pressure therein, wherein a pressure level of said intermediate pressure is between outlet and inlet pressures of the first compression source for further adjusting a phase difference between a pressure change and a position change of the working fluid in the pulse tube.

3. A pulse tube refrigerator according to claim 2, wherein the buffer tank and the refrigerating portion are connected via a buffer side valve.

4. A pulse tube refrigerator according to claim 1, including a controller configured and connected to control an opening state of the first high pressure supply valve to overlap with at least a part of an opening state of the second high pressure supply valve during a pressure increasing stage of the working fluid in the pulse tube.

5. A pulse tube refrigerator according to claims 1, including a controller configured and connected to control an opening state of the first low pressure supply valve to overlap with at least a part of the opening state of the second low pressure supply valve during a pressure decreasing stage of the working fluid in the pulse tube.

6. A pulse tube refrigerator comprising:

a refrigerating portion formed by a regenerator, a low temperature heat exchanger, a pulse tube and a high temperature heat exchanger fluidically connected in this order:

a first compression source having an outlet port and an inlet port;

a first high pressure supply valve via which the outlet port of the first compression source connects to the regenerator;

a first low pressure supply valve via which the inlet port of the first compression source connects to the regenerator;

a second compression source having an outlet port and an inlet port;

a second high pressure supply valve via which the outlet port of the second compression source connects to the high temperature heat exchanger; and a second low pressure supply valve via which the inlet port of the second compression source connects to the high temperature heat exchanger.

7. A pulse tube refrigerator according to claim 6, further comprising a buffer tank connected to the high temperature heat exchanger and keeping an intermediate pressure therein, wherein a pressure level of said intermediate pressure is between outlet and inlet pressures of the first compression source.

8. A pulse tube refrigerator according to claim 7, further comprising a buffer side valve via which the buffer tank connects to the high temperature heat exchanger.

9. A pulse tube refrigerator according to claim 6, including a controller configured and connected to control an opening state of the first high pressure supply valve to overlap with at least a part of an opening state of the second high pressure supply valve during a pressure increasing stage of the working fluid in the pulse tube.

10. A pulse tube refrigerator according to claims 6, including a controller configured and connected to control an opening state of the first low pressure supply valve to overlap with at least a part of the opening state of the second low pressure supply valve during a pressure decreasing stage of the working fluid in the pulse tube.

11. A pulse tube refrigerator comprising:

a refrigerating portion including a regenerator, a low temperature heat exchanger, a pulse tube and a high temperature heat exchanger fluidically connected in this order;

a first pressure oscillator comprising a first compression source, a first high pressure supply valve, and a first low pressure supply valve, wherein the regenerator is connected with outlet and inlet ports of the first compression source via the first high pressure supply valve and the first low pressure supply valve, respectively; and a second pressure oscillator provided independently of the first pressure oscillator, said second pressure oscillator having a second compression source, a second high pressure supply valve, and a second low pressure supply valve, wherein the high temperature heat exchanger is connected with outlet and inlet ports of the second compression source via the second high pressure supply valve and the second low pressure supply valve, respectively.

12. A pulse tube refrigerator according to claim 11, further comprising a buffer connected to the high temperature heat exchanger.

13. A pulse tube refrigerator according to claim 12, wherein the buffer tank and the refrigerating portion are connected via a buffer side valve.

14. A pulse tube refrigerator according to claim 11, including a controller configured and connected to control an opening state of the first high pressure supply valve to overlap with at least a part of an opening state of the second high pressure supply valve during a pressure increasing stage of the working fluid in the pulse tube.

15. A pulse tube refrigerator according to claims 11, including a controller configured and connected to control an opening state of the first low pressure supply valve to overlap with at least a part of the opening state of the second low pressure supply valve during a pressure decreasing stage of the working fluid in the pulse tube.

* * * * *